US006529579B1

(12) United States Patent
Richardson

(10) Patent No.: US 6,529,579 B1
(45) Date of Patent: Mar. 4, 2003

(54) COOLING SYSTEM FOR HIGH POWER X-RAY TUBES

(75) Inventor: John Richardson, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/525,846

(22) Filed: Mar. 15, 2000

(51) Int. Cl.[7] ..... H01J 35/10

(52) U.S. Cl. ..... 378/130; 378/127; 378/137; 378/141; 378/200

(58) Field of Search ..... 378/127, 130, 378/141, 137, 200, 203, 140, 143; 313/313; 315/85; 174/35 MS, 35 TS

(56) References Cited

U.S. PATENT DOCUMENTS

| | | | | | |
|---|---|---|---|---|---|
| 4,115,697 | A | | 9/1978 | Hounsfield et al. | 250/445 T |
| 4,622,687 | A | | 11/1986 | Whitaker et al. | 378/130 |
| 4,709,559 | A | | 12/1987 | Dotzauer et al. | 378/200 |
| 4,780,901 | A | * | 10/1988 | Gabbay et al. | 378/141 |
| 4,993,055 | A | * | 2/1991 | Rand et al. | 378/137 |
| 5,018,181 | A | | 5/1991 | Iversen et al. | 378/144 |
| 5,541,975 | A | | 7/1996 | Anderson et al. | 378/130 |
| 5,689,542 | A | | 11/1997 | Lavering et al. | 378/142 |
| 5,703,926 | A | * | 12/1997 | Bischof | 378/200 |
| 5,737,387 | A | | 4/1998 | Smither | 378/130 |
| 5,909,479 | A | * | 6/1999 | Rother | 378/121 |
| 6,002,745 | A | | 12/1999 | Miller et al. | 378/128 |
| 6,055,294 | A | * | 4/2000 | Foerst et al. | 378/137 |
| 6,074,092 | A | | 6/2000 | Andrews | 378/200 |
| 6,084,942 | A | * | 7/2000 | Hell et al. | 378/130 |
| 6,115,454 | A | | 9/2000 | Andrews et al. | 378/140 |
| 6,125,169 | A | | 9/2000 | Wandke et al. | 378/143 |
| 6,128,367 | A | * | 10/2000 | Foerst et al. | 378/137 |
| 6,181,771 | B1 | * | 1/2001 | Hell et al. | 378/137 |
| 6,213,639 | B1 | * | 4/2001 | Hell et al. | 378/200 |

* cited by examiner

*Primary Examiner*—Drew A. Dunn
(74) *Attorney, Agent, or Firm*—Workman, Nydegger & Seeley

(57) ABSTRACT

A cooling system for use with high-powered x-ray tubes. The cooling system includes a reservoir containing liquid coolant, in which the high-powered x-ray tube is partially immersed. In general, the liquid coolant is cooled and then circulated through the reservoir by an external cooling unit. The cooling system also includes a shield structure attached to the vacuum enclosure of the high-powered x-ray tube and disposed substantially about the aperture portion of the vacuum enclosure, thereby defining a flow passage proximate to the aperture portion. Liquid coolant supplied by the external cooling unit enters the flow passage by way of an inlet port in the shield structure. After passing through the flow passage and transferring heat out of the aperture portion, the liquid coolant is discharged through an outlet port in the shield structure and enters the reservoir to repeat the cycle.

23 Claims, 9 Drawing Sheets

COOLING SYSTEM FOR HIGH POWER X-RAY TUBES

BACKGROUND OF THE INVENTION

1. The Field of the Invention

The present invention relates generally to x-ray tubes. More particularly, embodiments of the present invention relate to an x-ray tube cooling system that increases the rate of heat transfer from the x-ray tube to a cooling system medium so as to significantly reduce heat-induced stress and strain in the x-ray tube structures and thereby extend the operating life of the device.

2. The Prior State of the Art

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing. While used in a number of different applications, the basic operation of x-ray tubes is similar. In general, x-rays, or x-ray radiation, are produced when electrons are produced, accelerated, and then impinged upon a material of a particular composition.

Typically, this process is carried out within a vacuum enclosure. Disposed within the evacuated enclosure is an electron generator, or cathode, and a target anode, which is spaced apart from the cathode. In operation, electrical power is applied to a filament portion of the cathode, which causes electrons to be emitted. A high voltage potential is then placed between the anode and the cathode, which causes the emitted electrons accelerate towards a target surface positioned on the anode. Typically, the electrons are "focused" into a primary electron beam towards a desired "focal spot" located at the target surface. In addition, some x-ray tubes employ a deflector device to control the direction of the primary electron beam.

For example, a deflector device can be a magnetic coil disposed around an aperture that is disposed between the cathode and the target anode. The magnetic coil is used to produce a magnetic field that alters the direction of the primary electron beam. The magnetic force can thus be used to manipulate the direction of the beam, and thereby adjust the position of the focal spot on the anode target surface. A deflection device can be used to control the size and/or shape of the focal spot.

During operation of an x-ray tube, the electrons in the primary electron beam strike the target anode surface (or focal track) at a high velocity. The target surface on the target anode is composed of a material having a high atomic number, and a portion of the kinetic energy of the striking electron stream is thus converted to electromagnetic waves of very high frequency, i.e., x-rays. The resulting x-rays emanate from the target surface, and are then collimated through a window formed in the x-ray tube for penetration into an object, such as a patient's body. As is well known, the x-rays can be used for therapeutic treatment, or for x-ray medical diagnostic examination or material analysis procedures.

A percentage of the electrons that strike the target anode target surface rebound from the surface and then either impact at other random areas on the target surface, or at other "non-target" surfaces within the x-ray tube evacuated enclosure. The electrons within this secondary electron beam are often referred to as "secondary" electrons. These secondary electrons retain a significant amount of kinetic energy after rebounding, and when they impact these other non-target surfaces a significant amount of heat is generated. This heat can ultimately damage the x-ray tube, and shorten its operational life. For example, the temperatures generated by secondary electrons, in conjunction with the high temperatures generated by the primary electrons at the focal spot of the target surface, often reach levels high enough to damage portions of the x-ray tube structure. For example, the joints and connection points between x-ray tube structures can be weakened when repeatedly subjected to such thermal stresses. In some instances, the resulting temperatures can even melt portions of the x-ray tube, such as lead shielding disposed on the evacuated enclosure. These situations can shorten the operating life of the tube, affect its operating efficiency, and/or render it inoperable.

Further, because the trajectories of secondary electrons cause them to impact some interior surface locations with relatively greater frequency than other areas, the resulting heat distribution can be uneven. The varying rates of thermal expansion cause mechanical stresses and strains when the cooler part of the structure resists the expansion of the hotter portion of the structure. Ultimately, this can cause a mechanical failure in the part, especially over numerous operating cycles.

While the aforementioned problems are cause for concern in all x-ray tubes, these problems become particularly acute in the new generation of high-power x-ray tubes which have relatively higher operating temperatures than the typical devices. In general, high-powered x-ray devices have operating powers that exceed 20 kilowatts (kw).

Attempts have been made to reduce temperatures in such areas of high heat concentration, and to minimize thermal stress and strain, through the use of various types of cooling systems. However, previously available x-ray tube cooling systems have not been entirely satisfactory in providing effective and efficient cooling, and have been especially ineffectual in those particular regions of the tube that are subjected to high temperatures, such as from rebounding electrons. Moreover, the inadequacies of known x-ray tube cooling systems are further exacerbated by the increased heat levels that are characteristic in high-powered x-ray tubes.

For example, conventional x-ray tube systems often utilize some type of liquid cooling arrangement. In such systems, at least some of the external surfaces of the vacuum enclosure are placed in contact with a circulating coolant, which facilitates a convective cooling process. While these types of processes are adequate to cool some portions of the x-ray tube, they may not adequately cool areas of localized heat—such as those that are susceptible to heating from secondary electrons, including the aperture and window areas of the tube.

In fact, conventional cooling processes are particularly ineffective for cooling the aperture portion, because it presents a limited external surface area with which to effectuate heat transfer to the surrounding coolant. Moreover, the positioning of a deflection mechanism, such as a magnetic coil, further inhibits adequate cooling of the aperture when conventional methods are used. In particular, a magnetic coil (or similar deflection mechanism), is disposed around the periphery of the aperture, so its position prevents—or at least limits—the amount of heat that can be convectively transferred from the aperture to the surrounding coolant.

In addition to the aperture, the window area of the x-ray tube is also particularly susceptible to heat generated from rebounding electrons due to its proximity to the anode target. In fact, even in relatively low-powered x-ray tubes, the window area can become sufficiently hot to boil coolant that is adjacent to the window. The bubbles produced by such boiling may obscure the window of the x-ray tube and thereby compromise the quality of the images produced by the x-ray device. Further, boiling of the coolant can result in the chemical breakdown of the coolant, thereby rendering it ineffective, and necessitating its removal and replacement. Also, the window structure itself can be damaged from the excessive heat; for instance, the weld between the window structure and the evacuated housing can fail.

In view of the foregoing problems and shortcomings with existing x-ray tube cooling systems, it would be an advancement in the art to provide a cooling system that removes heat from the x-ray tube, and that effectively removes heat from specific regions of the tube, such as the aperture and window portions of the vacuum enclosure. Further, the cooling system should effect sufficient heat removal so as to reduce the amount of thermally-induced mechanical stresses otherwise present within the x-ray tube, and thereby increase the overall operating life of the x-ray tube. Likewise, the cooling system should substantially prevent heat-related damage from occurring in the materials used to fabricate the vacuum enclosure, and should reduce structural damage occurring at joints between the various structural components of the x-ray tube.

SUMMARY AND OBJECTS OF THE INVENTION

The present invention has been developed in response to the current state of the art, and in particular, in response to these and other problems and needs that have not been fully or adequately solved by currently available x-ray tube cooling systems. Thus, it is an overall object of embodiments of the present invention to provide a cooling system that effectively and efficiently removes excessive heat from x-ray tube components.

It is also an object to provide a cooling system that will efficiently and effectively remove heat from specific regions of the x-ray tube that are routinely exposed to particularly high temperatures. Similarly, it is an objective to remove heat at a higher rate from these specific regions—as opposed to other relatively cooler regions—so as to maintain a substantially uniform thermal state as between the various x-ray tube regions and avoid destructive thermal expansion discrepancies.

Another related objective is to remove sufficient heat from the x-ray tube as to reduce the occurrence of thermally induced stresses that could otherwise reduce the tube's operating efficiency, limit its operating life, and/or render the tube inoperable.

In summary, these and other objects, advantages, and features are achieved with an improved cooling system for use in effecting heat transfer from any x-ray tube. Embodiments of the present invention are particularly suitable for use with high-powered x-ray tubes.

In a preferred embodiment, the x-ray tube cooling system utilizes a liquid coolant that is continuously circulated through a coolant reservoir by an x-ray cooling unit. The system also includes a shield structure that is disposed about an exterior surface of the x-ray tube vacuum enclosure, and preferably in a manner such that the shield is substantially adjacent to both the aperture portion and the electron beam deflection device that is disposed around the aperture. In presently preferred embodiments, the shield structure includes an inlet port and an outlet port. The inlet port is in direct fluid communication with the external cooling unit and the outlet port is in fluid communication with the interior of the coolant reservoir.

In operation, the heat is removed from the coolant by the external cooling unit, and the coolant is then supplied directly to the shield structure by way of the inlet port. As the coolant proceeds through the flow passage defined by the shield structure, heat radiated from the aperture portion and the deflection device is absorbed. In a preferred embodiment, the coolant is then discharged into the reservoir from the outlet port. In preferred embodiments, the discharged fluid is directed across the window area of the x-ray tube, so as to enhance the removal of heat from that particular region. Also, since in preferred embodiments all coolant exiting the external cooling unit proceeds directly through the inlet port of the shield structure, heat is removed from the region of the aperture at an increased rate. Moreover, the unique positioning and orientation of the shield ensures adequate heat removal from the aperture portion—even in the presence of the deflection device.

BRIEF DESCRIPTION OF THE DRAWINGS

In order to more fully understand the manner in which the above recited and other advantages and objects of the invention are obtained, a more particular description of the invention will be rendered by reference to specific embodiments thereof which are illustrated in the appended drawings. It will be appreciated that the drawings are not necessarily drawn to scale, and that they are intended to depict only the presently preferred and best mode embodiments of the invention, and are not to be considered to be limiting of the scope of the invention.

DETAILED DESCRIPTION OF THE PREFERRED EMBODIMENTS

Reference will now be made to figures wherein like structures will be provided with like reference designations. It is to be understood that the drawings are diagrammatic and schematic representations of various embodiments of the invention, and are not to be construed as limiting the present invention, nor are the drawings necessarily drawn to scale.

In general, the present invention relates to cooling systems for use in cooling high-powered x-ray tubes, although it will be appreciated that the instant invention could find application in any type of x-ray tube environment requiring improved cooling. FIGS. 1 through 5A indicate various embodiments of a cooling system conforming to the teachings of the invention.

Figure 1:
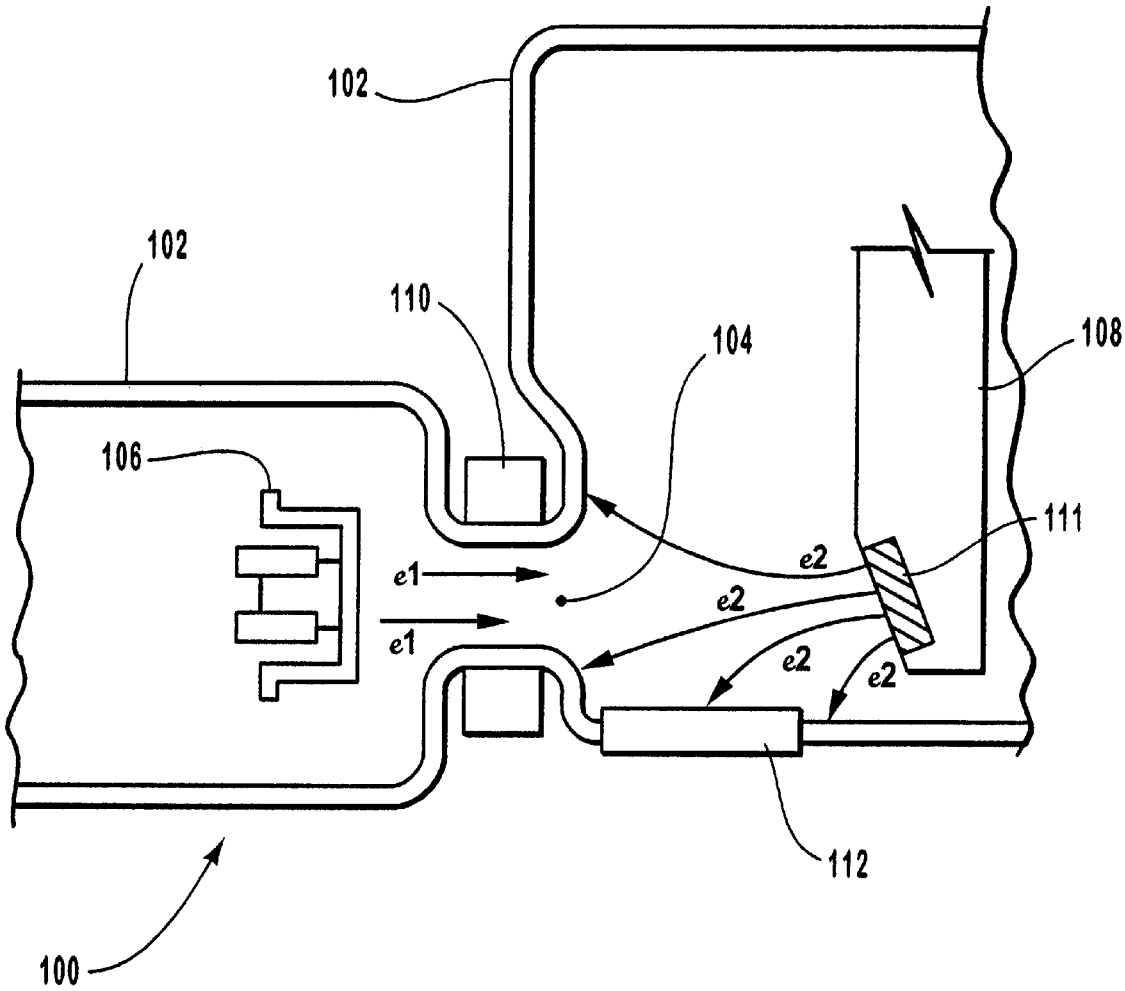
FIG. 1 is a cutaway view of an x-ray tube, depicting some of the fundamental elements of the x-ray tube, and indicating typical travel paths of secondary electrons.

Reference is first made to FIG. 1, which depicts an x-ray tube indicated generally as 100. X-ray tube 100 includes a vacuum enclosure 102, and disposed inside vacuum enclosure 102 on opposite sides of an aperture portion 104 are an electron source 106 and a target anode 108. In operation, power is applied to electron source 106, which causes a beam of electrons e1 to be emitted by thermionic emission. A potential difference is applied between the electron source 106 and target anode 108, which causes the electrons e1 to accelerate through the aperture portion 104 and impinge upon a focal spot 111 location on the target anode 108. A portion of the resulting kinetic energy is released as x-rays (not shown), which are then collimated and emitted through window 112 and into, for example, the body of a patient.

In the embodiment illustrated, as the electrons e1 pass through aperture portion 104, a deflector device 110 is used to steer, or redirect, the trajectory of the electron beam. In this way, the position, size and/or shape of the focal spot 111 on the target anode 108 can be adjusted, thereby affecting the characteristics of the x-ray signal and/or the resulting x-ray image. In one embodiment, the deflection device 110 comprises a B-field generator such as a magnetic coil, or the like.

As is represented in FIG. 1, some of the electrons strike and then rebound from the surface target anode 108, and then strike other "non-target" areas, such as the aperture portion 104, the window 112, and/or other areas within the enclosure 102. As discussed elsewhere, the kinetic energy of these secondary electron e2 collisions generate extremely high temperatures. Moreover, since a majority of the rebounding electrons strike the aperture portion 104 and the window 112, a majority of the heat is created in those particular regions. This heat must be reliably and continuously removed.

Figure 2:
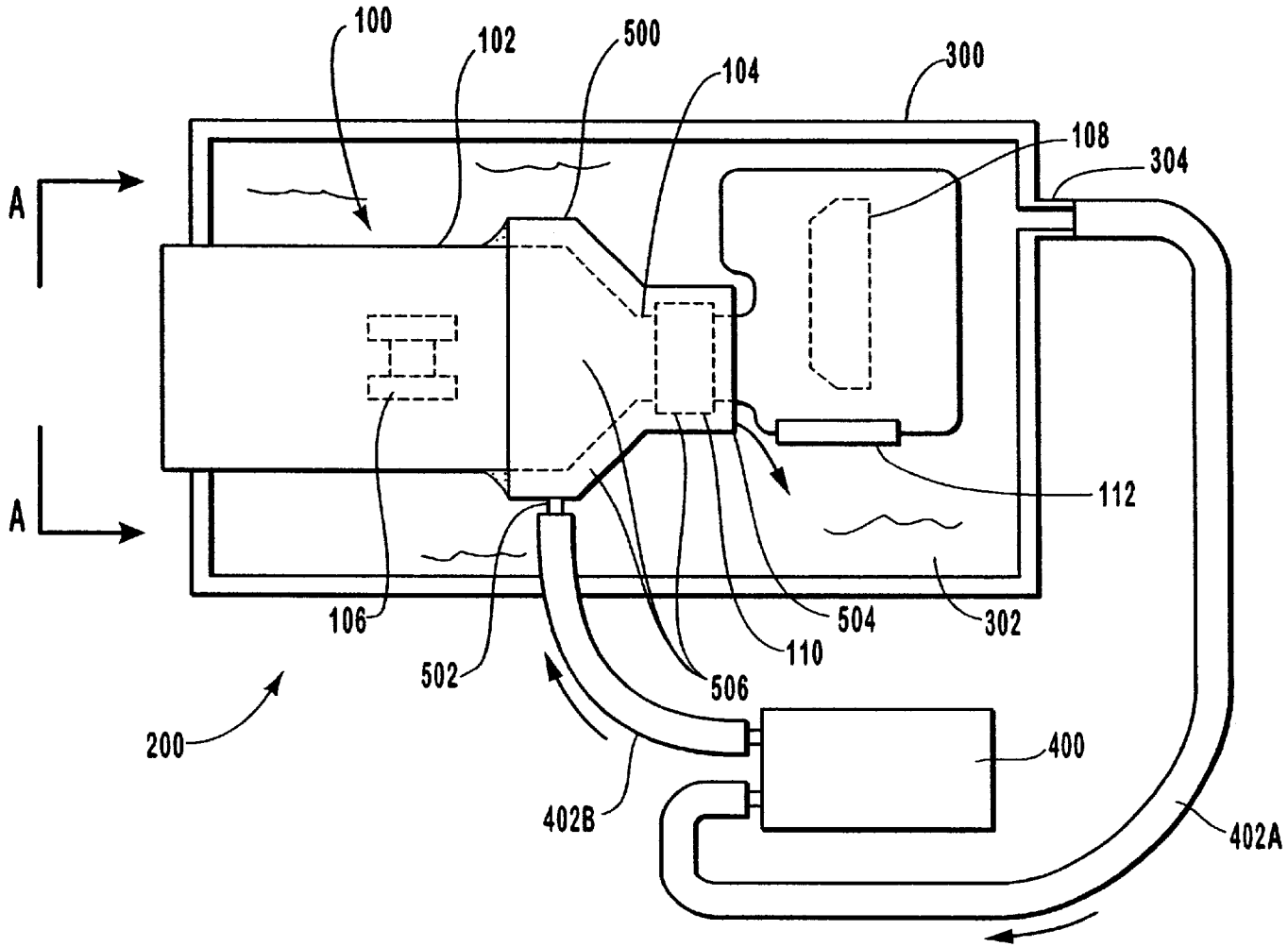
FIG. 2 is a top view of an embodiment of a cooling system for use with an x-ray tube, indicating the disposition and interrelationships of various elements of the cooling system, including an external cooling unit, a shield structure, and a reservoir.

Directing attention now to FIG. 2, a presently preferred embodiment of a cooling system, depicted generally as 200, is indicated. Cooling system 200 includes a reservoir 300 containing a liquid coolant 302 in which x-ray tube 100 is at least partially immersed. The liquid coolant 302 is continuously circulated through reservoir 300 by external cooling unit 400, which includes a fluid pump or the like. In a preferred embodiment, the liquid coolant 302 is a dielectric oil, but can be any appropriate fluid that is capable of functioning as a heat transfer medium. The external cooling unit 400 also preferably comprises a heat exchanger, or the like, that is configured to remove heat from liquid coolant 302 as it is received from reservoir 300 via conduit 402A.

The cooling system 200 further includes a shield structure 500, which in the illustrated embodiment is attached to vacuum enclosure 102. The shield 500 includes an inlet port 502 that is connected directly to the external cooling unit 400 by way of fluid conduit 402B. The shield structure 500 also includes an outlet port 504, that is connected in fluid communication with the interior of reservoir 300. In a preferred embodiment, the shield structure 500 is constructed of a metal such as stainless steel, or the like. However, it will be appreciated that a variety of other materials, or combinations of materials, such as copper, iron or alloys thereof, are equally suitable.

Note also that the present invention contemplates as within its scope shield structures incorporating multiple inlet ports 502 and/or multiple outlet ports 504. Further, the sizes of inlet port 502 and/or outlet port 504 may be varied as necessary to accommodate desired coolant flow rates and/or heat transfer rates. Finally, while FIG. 2 indicates inlet port 502 as being on the side of the x-ray tube 100 that is proximate to window 112, it will be appreciated that inlet port 502 may be located elsewhere on shield structure 500 as necessary to achieve a desired type of fluid flow and heat transfer rate, depending on the application. Likewise, outlet port 504 may be located on shield structure 500 other than as shown in FIG. 2.

With continuing reference to FIG. 2, in operation the liquid coolant 302 exits 3 reservoir 300 by way of reservoir outlet 304 and conduit 402A, and flows into external cooling unit 400. Heat is removed from the liquid coolant 302 and coolant is then passed directly into the shield structure via hose 402B and inlet port 502. As will be discussed in further detail below, the coolant flows through at least one passageway that is formed within the shield 500, thereby absorbing heat conducted from the adjacent surfaces of the x-ray tube enclosure 102. After circulation through the shield 500, the liquid coolant 302 is discharged through outlet port 504 into reservoir 300. Coolant is circulated throughout the reservoir 300, further absorbing heat that is dissipated from other portions of the x-ray tube 100. Heated coolant ultimately exits the reservoir 300 at port 304, and the process is then repeated. While FIG. 2 indicates that all flow from external cooling unit 400 is directed in the first instance to shield structure 500, it will be appreciated that at least a portion of the flow of liquid coolant 302 exiting external cooling unit 400 may alternatively be directed to a location, or locations, other than shield structure 500, so as to achieve a desired cooling effect. For example, some fluid may be diverted directly to the surface of window 112, or to other regions of the x-ray tube that require enhanced cooling.

As is further indicated in the embodiment of FIG. 2, the shield structure 500 is attached to the exterior surface of the vacuum enclosure 102, and preferably defines at least one flow passage 506 that is proximate to both the aperture portion 104 and deflection device 110. The shield structure 500 is preferably attached as a separate piece to the vacuum enclosure 102 by a welding process, or the like. However, this invention contemplates as within its scope any attachment processes and/or connection joints effective in facilitating the functionality of shield structure 500 as disclosed herein. Similarly, the shield structure 500 could be fabricated as an integral piece with the vacuum enclosure 102.

Note that a variety of means could be employed to perform the functions of the disclosed shield structure 500 (and auxiliary shield structure 500A discussed in greater detail below). Shield structure 500 is but one example of means for defining a flow passage that is substantially proximate to aperture portion 104. Accordingly, the structure disclosed herein simply represents one embodiment of structure capable of performing these functions. It should be understood that this structure is presented solely by way of example and should not be construed as limiting the scope of the invention in any way.

Figure 3:
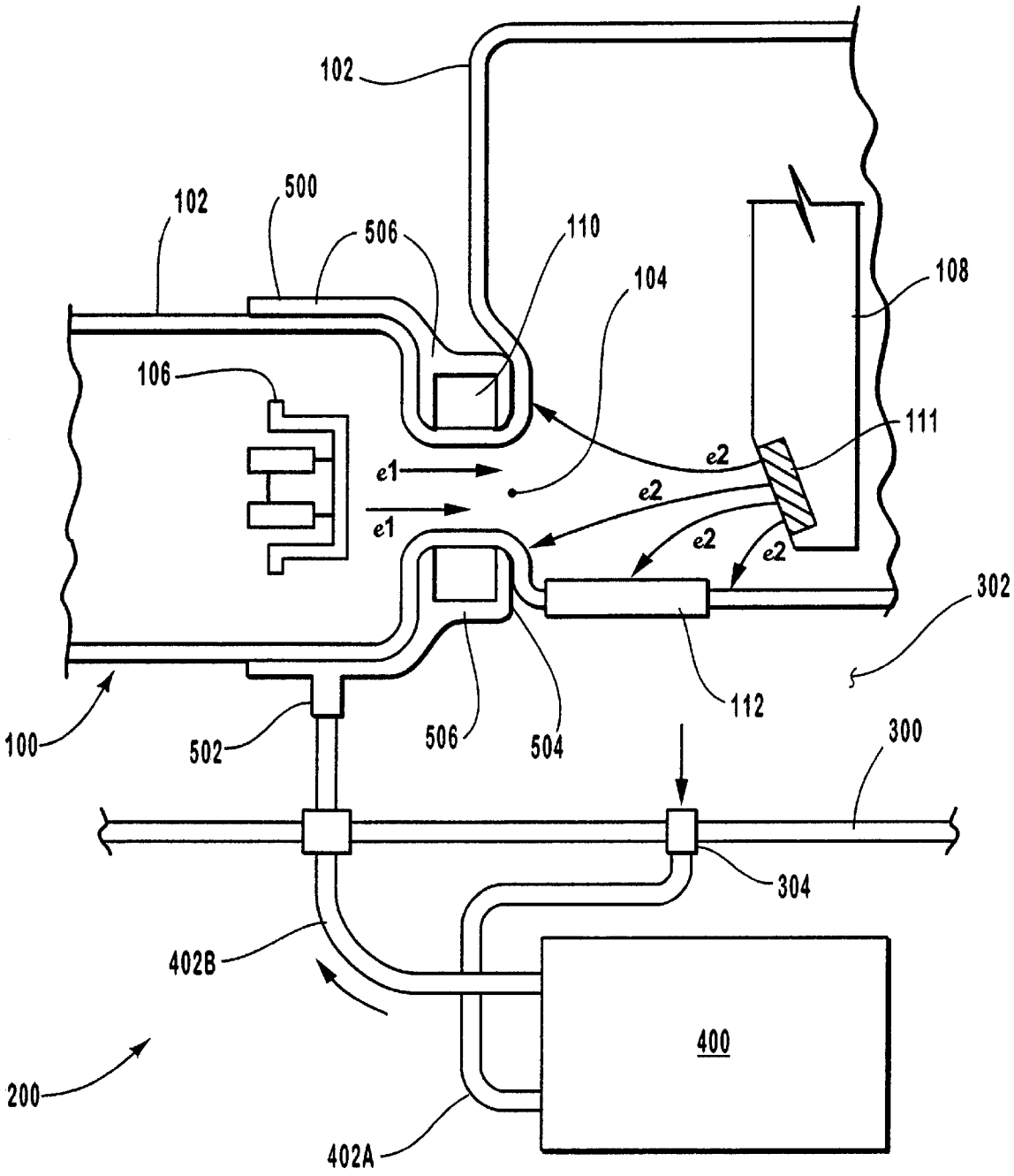
FIG. 3 is a downward-looking section view, taken along line A—A of FIG. 2, of an x-ray tube and one embodiment of a shield structure, and illustrates as well elements of an embodiment of a cooling system and their relation to the shield structure.
Figure 3A:
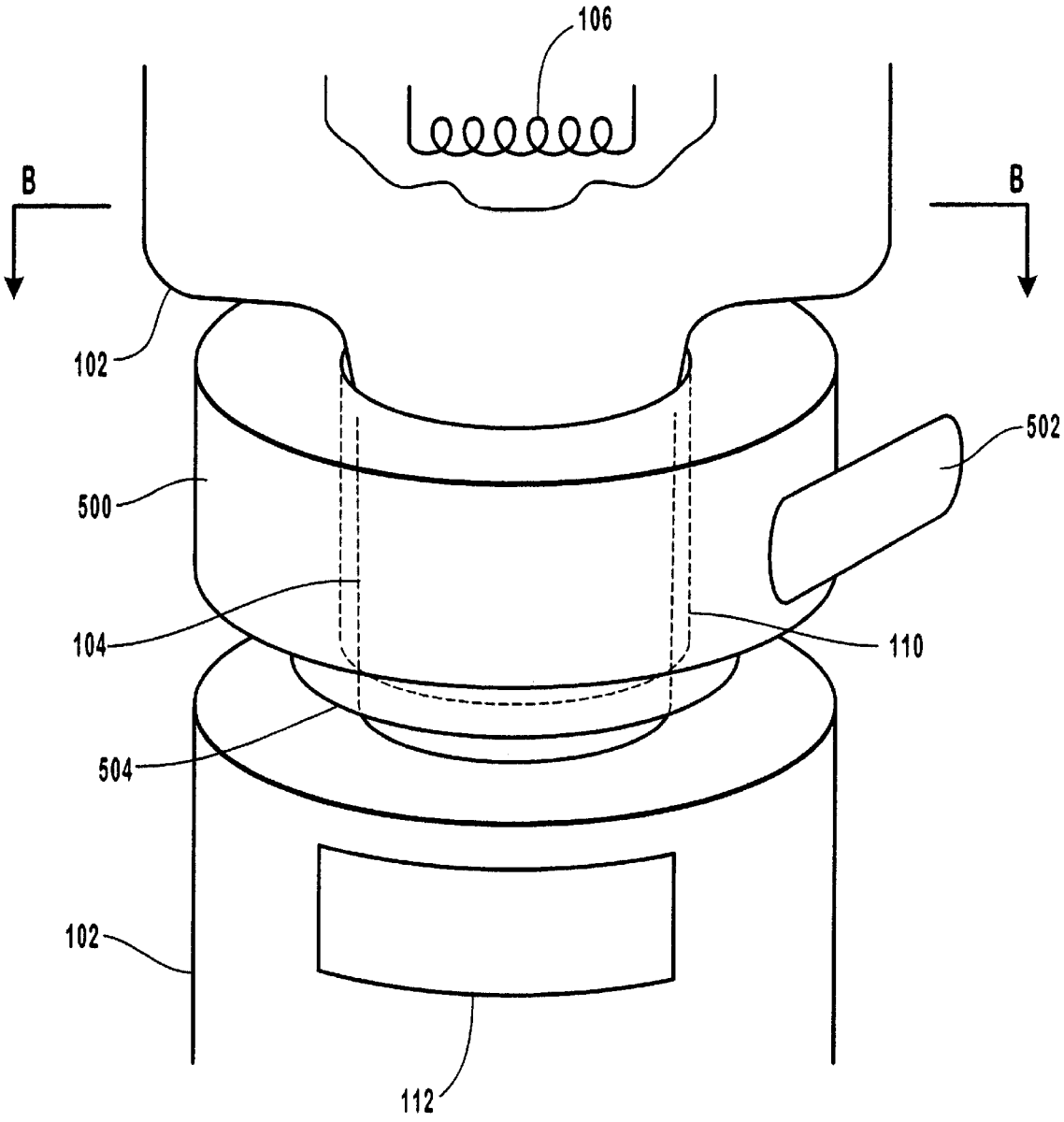
FIG. 3A is a perspective view of an embodiment of a shield structure disposed about the aperture portion and deflector device of an x-ray tube.
Figure 3B:
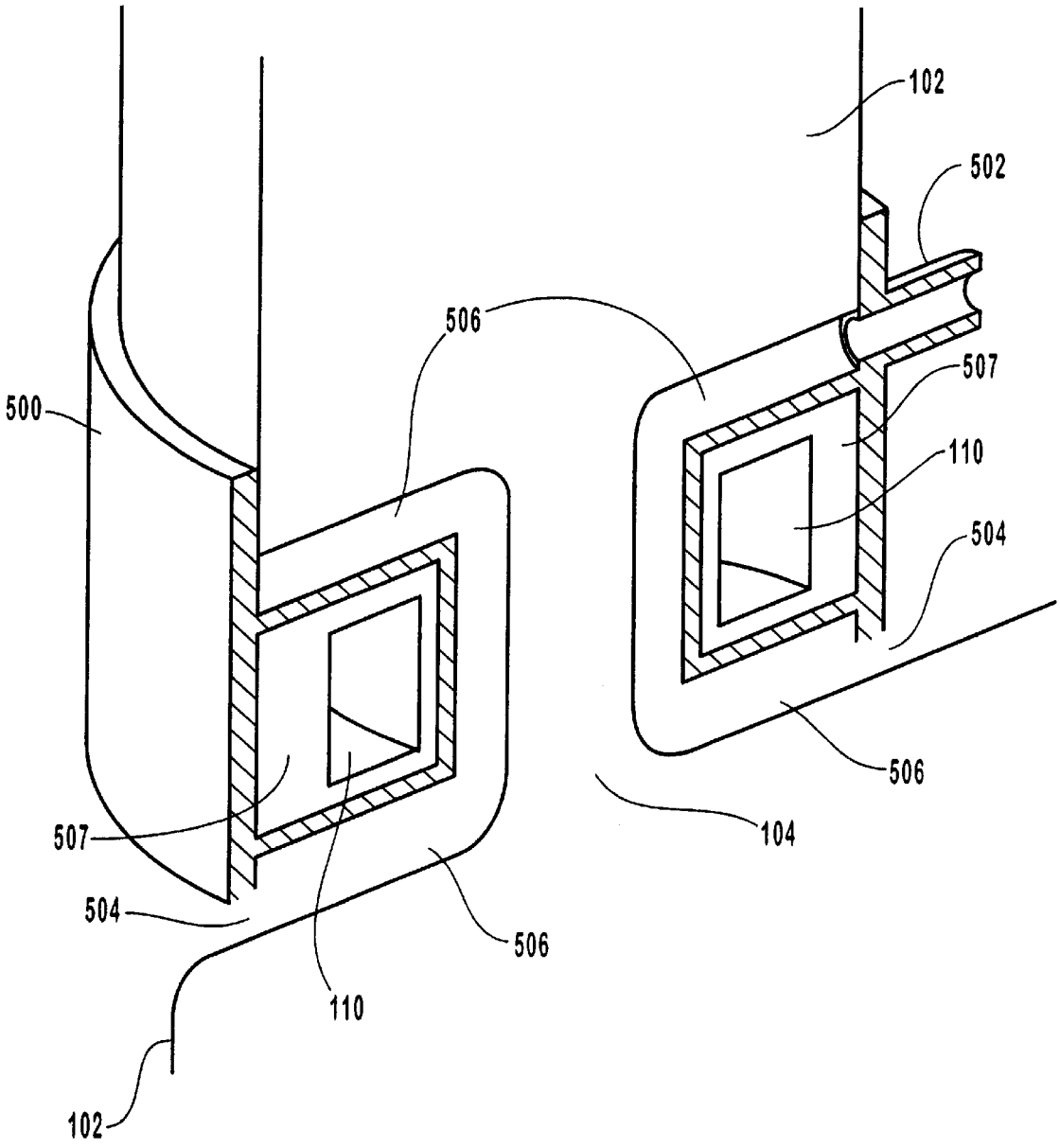
FIG. 3B is a perspective section view taken along line B—B of FIG. 3A, indicating various structural details of an embodiment of a shield structure.

Directing attention now to FIGS. 3, 3A, and 3B, the shield structure 500, by defining flow passage 506, directs liquid coolant 302 from inlet port 502 to the aperture portion 104 so that flowing liquid coolant 302 comes into substantial heat-absorbing contact with aperture portion 104. Heat is conducted from the aperture region to the exterior surface of the enclosure 102, and is at least partially absorbed by the liquid coolant 302 that is received directly from the external cooling unit 400. Moreover, the orientation of the shield ensures that the coolant provides a high degree of heat removal even in the presence of the deflection device 110, which otherwise prevents the aperture region from being in direct fluid contact with fluid in the reservoir.

It will be appreciated that the size, geometry, and/or construction materials used for shield structure 500 may be varied as desired to facilitate adjustment of liquid coolant 302 flow parameters including, but not limited to, liquid coolant 302 flow rate. For example, the geometry of shield structure 500 could be constructed so as to permit an increased flow rate of liquid coolant 302 through shield structure 500, and thereby achieve a desired cooling effect. Likewise, the size, geometry, and/or construction materials of shield structure 500 may be varied as required to suit the geometry and construction of a particular x-ray tube 100.

The physical orientation of shield structure 500 may be also be varied to achieve different cooling affects. For example, in FIG. 3, the deflector device 110 is positioned for the enclosure 102 so as to define a flow path 506 that directs liquid coolant 302 into substantially adjacent contact with both the deflector device 110 and the aperture portion 104. Alternatively, FIGS. 3A and 3B disclose an embodiment of a shield structure 500 that is interposed between deflector device 110 and aperture portion 104 so as to define a flow path 506 in immediate contact with aperture portion 104, and an isolation chamber 507 which isolates deflector device 110 from direct contact with liquid coolant 302. It will be appreciated that alternative arrangements, in addition to those disclosed in FIGS. 3, 3A and 3B, may be effectively employed as well. Accordingly, such alternative arrangements are contemplated as being within the scope of the present invention.

The cooling of aperture portion 104 is further enhanced by cooling system 200 because, as noted above, in one presently preferred embodiment the liquid coolant 302 is directed immediately and solely to the shield structure 500 upon exiting external cooling unit 400. Thus, the liquid coolant 302 flowing into shield structure 500 from external cooling unit 400 is in a relatively 'cold' state and is therefore able to absorb relatively more heat. The illustrated cooling system 200 thus takes maximum advantage of the heat absorption capacity of liquid coolant 302 exiting external cooling unit 400 and is accordingly able to effectuate a relatively higher rate of heat transfer from aperture portion 104 to liquid coolant 302 than is possible with conventional cooling system designs.

Figure 4:
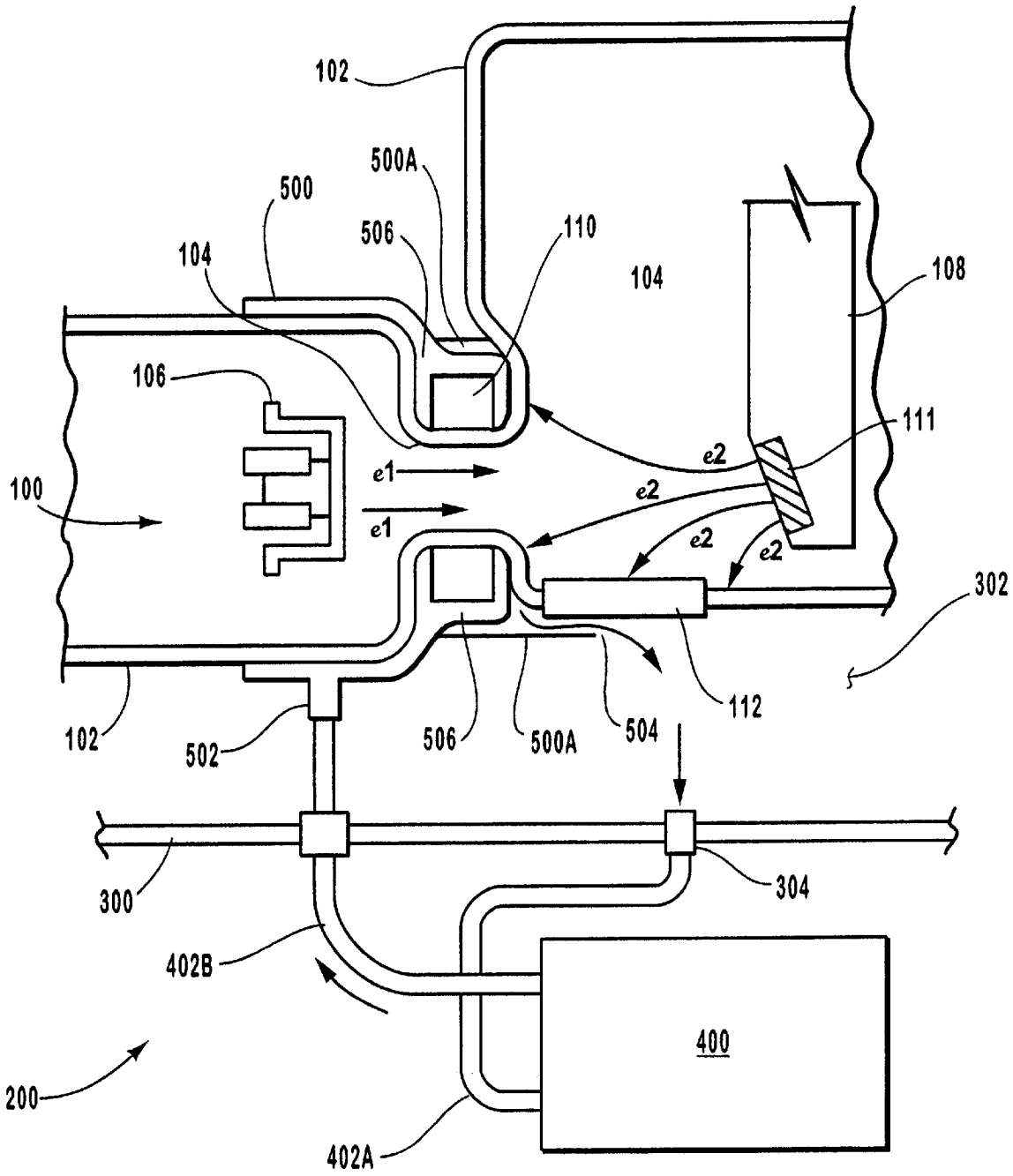
FIG. 4 is a downward-looking section view oriented in substantially the same fashion as indicated in FIG. 3, of an x-ray tube and another embodiment of a shield structure, and illustrates as well elements of an embodiment of a cooling system and their relation to the shield structure.

Directing attention now to FIG. 4, an alternative embodiment of cooling system 200 is indicated. The embodiment depicted in FIG. 4 includes a shield structure 500, which defines a flow passage 506 that is proximate to aperture portion 104 and deflection device 110. As before, the liquid coolant 302 from the external cooling unit 400 passes through the passage 506 so as to effectuate heat transfer from the aperture portion 104 to the liquid coolant 302.

As is further indicated in FIG. 4, in addition to the shield structure 500, there is an auxiliary shield structure 500A. The auxiliary shield structure 500A is substantially disposed about aperture portion 104 and is attached to shield structure 500 and to vacuum enclosure 102, as indicated. It will be appreciated however, that the shield structure 500 and/or shield structure 500A could be arranged in various other ways while still preserving the functionality of those structures as disclosed herein. These various other arrangements are accordingly contemplated as being within the scope of the present invention. In a preferred embodiment, auxiliary shield structure 500A is integral with shield structure 500.

One function of the auxiliary shield structure 500A is to direct the discharge of liquid coolant 302 from outlet port 504 of shield structure 500 to one or more desired locations. In the embodiment of cooling system 200 illustrated in FIGS. 4 and 4A, auxiliary shield structure 500A defines a single outlet port 504 so that liquid coolant 302 exiting flow passage 506 is directed so as to flow into contact with the window 112 and the adjacent structure. As a result, a substantial amount of the liquid coolant 302 exiting outlet port 504 flows directly over window 112 and thereby provides a level of convective heat transfer from the region of the window 112. The cooling effect imposed by the flow of liquid coolant 302 exiting flow passage 506 thus desirably supplements the cooling effect realized by the contact between window 112 and the liquid coolant 302 in reservoir 300. By directing the flow of liquid coolant 302 in this way, auxiliary shield structure 500A, in conjunction with shield structure 500, serves to effect removal of a substantial portion of the heat generated by secondary electrons e2 at window 112 and the adjacent structure.

Figure 4A:
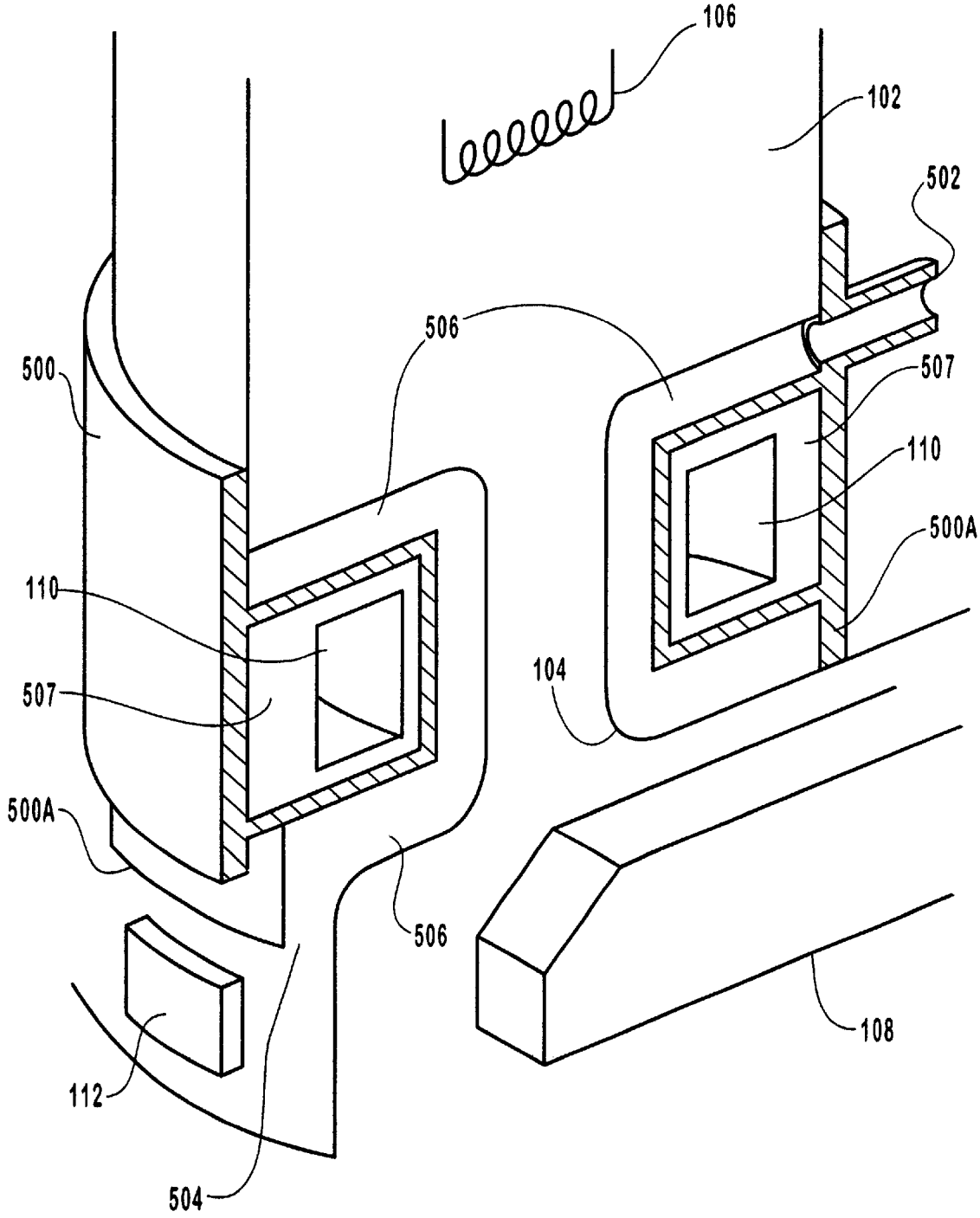
FIG. 4A is a perspective section view oriented in substantially the same fashion as indicated in FIG. 3B, and depicts an embodiment of a shield structure configured to discharge coolant over the window area of an x-ray tube.

The embodiment of cooling system 200 depicted in FIGS. 4 and 4A discloses a single outlet port 504 proximate to window 112 and the adjacent structure. It will be appreciated however, that auxiliary shield structure 500A may be configured and/or arranged so as to direct liquid coolant 302 to a plurality of predetermined locations by way of one or more outlet ports 504. Accordingly, the geometry and/or arrangement of outlet port(s) 504 may desirably be varied to suit a particular application.

With continuing attention to the embodiment of cooling system 200 depicted in FIG. 4, it will be appreciated that the cooling effect provided by coolant system 200 may be further enhanced by positioning inlet port 502 in close proximity to window 112. As discussed earlier, the entire flow of liquid coolant 302 exiting external cooling unit 400 is directed in the first instance through inlet port 502 of shield structure 500. As thus positioned in FIG. 4, inlet port 502 accordingly receives liquid coolant 302 in a state such that the ability of liquid coolant 302 to absorb heat is at its maximum. Thus, the ability of liquid coolant 302 to absorb heat from window 112 upon discharge from outlet port 504 is only partially diminished by the contact between liquid coolant 302 and aperture portion 104. Window 112 and the adjacent structure are thus desirably exposed to liquid coolant 302 having a relatively higher heat absorption capacity than would exist were inlet port 502 positioned elsewhere on shield structure 500. As indicated in FIG. 4A however, inlet port 502 may be located elsewhere on shield structure 500 in order to achieve a desired cooling effect.

Further, as is suggested in FIG. 4, at least some of the liquid coolant 302 supplied by external cooling unit 400 takes a relatively direct path from inlet port 502 to window 112. As is well known, the rate and amount of heat transfer from one medium to another at least partially corresponds to the length of time for which the media are in contact with each other. For instance, liquid coolant 302 taking a relatively direct path from inlet port 502 to window 112 will absorb less heat from aperture portion 104 than liquid coolant 302 which takes a relatively longer path. Thus, the length and orientation of the coolant flow path provided by passageway 506 can be varied to further enhance the overall cooling effectiveness of cooling system 200.

Figure 5:
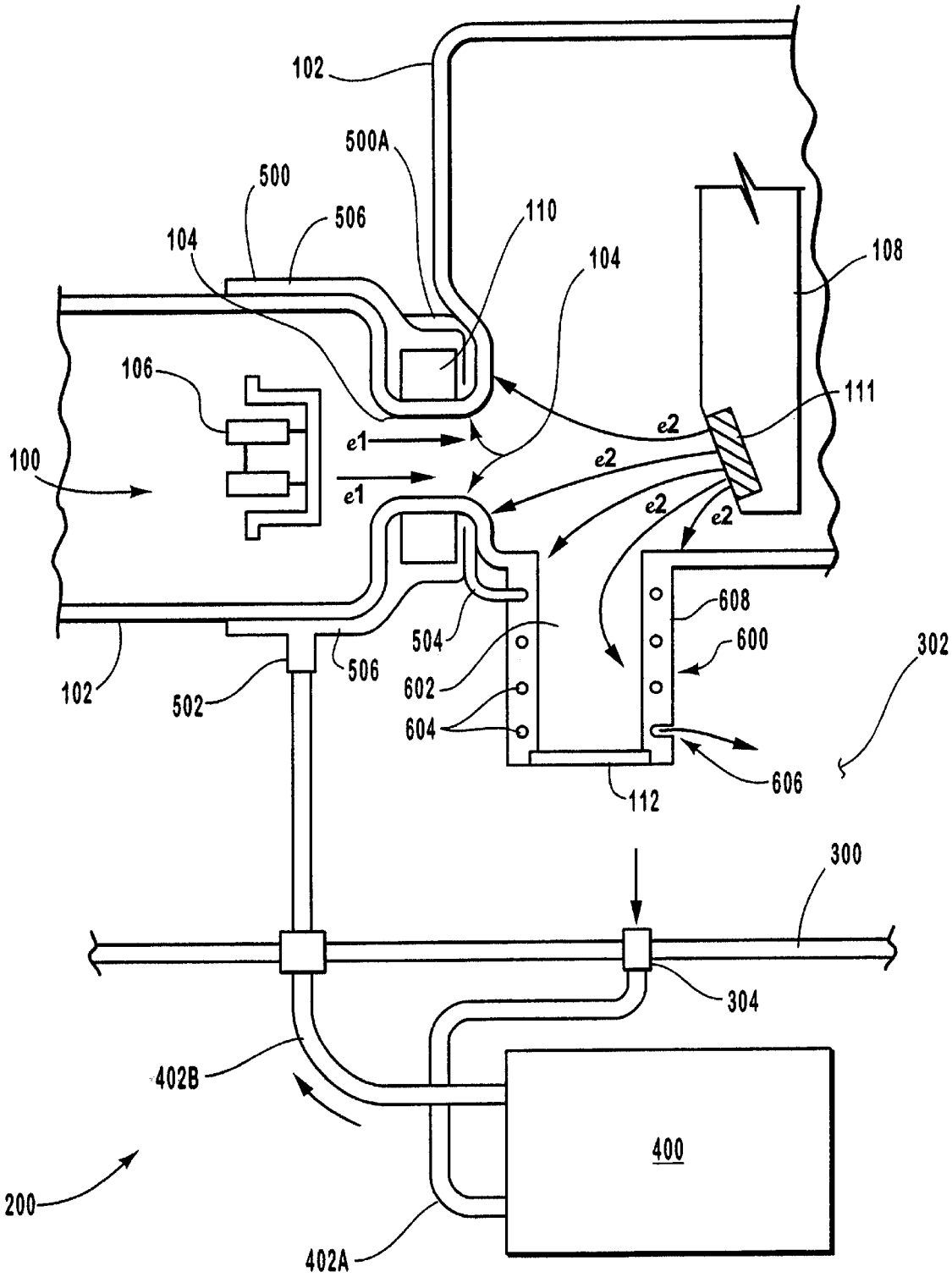
FIG. 5 is a downward-looking section view oriented in substantially the same fashion as indicated in FIG. 3, of an x-ray tube and another embodiment of a shield structure, and illustrates as well elements of an embodiment of a cooling system and their relation to the shield structure.
Figure 5A:
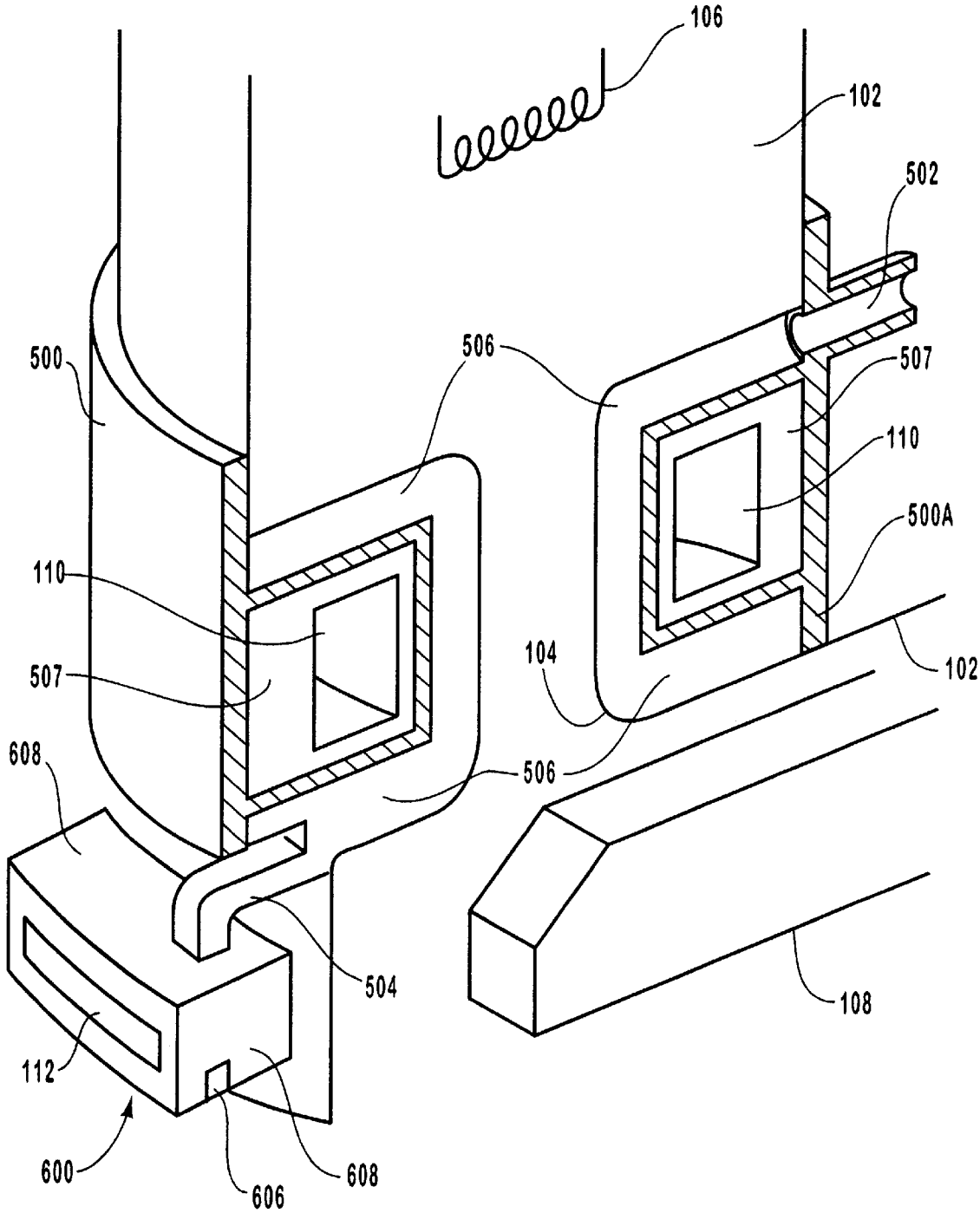
FIG. 5A is a perspective section view oriented in substantially the same fashion as indicated in FIG. 3B, and depicts an embodiment of a shield structure configured to discharge coolant through a window block of an x-ray tube.

Directing attention now to FIGS. 5 and 5A, another alternative embodiment of cooling system 200 is indicated. As in the case of the embodiments of cooling system 200 discussed above, the embodiment of cooling system 200 depicted in FIGS. 5 and 5A includes a shield structure 500, proximate to aperture portion 104 and deflection device 110, through which liquid coolant 302, supplied by external cooling unit 400, passes so as to effectuate heat transfer from aperture portion 104 to liquid coolant 302.

In addition to shield structure 500, auxiliary shield structure 500A, and external cooling unit 400, the features and operation of which are also discussed above, this embodiment further includes a window block 600. Window block 600 preferably comprises a metal such as copper, or the like, and is joined to vacuum enclosure 102 so as to define a portion thereof. Window block 600 defines a cavity 602 that is closed off at one end by x-ray transmissive window 112 and is in communication with the interior of vacuum enclosure 102 at the other end. X-rays that are emitted from the focal spot 111 on the anode target pass through the cavity 602 and exit through window 112. Note that while in one embodiment window block 600 comprises copper, this invention contemplates as within its scope any other window block 600 construction material, or materials, that provides the functionality disclosed herein.

As indicated in FIGS. 5 and 5A, one important feature of window block 600 is that it removes window 112 a predetermined distance away from target anode 108. As suggested in FIG. 5, the geometry of window block 600 is such as to significantly reduce the number of secondary electrons e2 that are able to reach and impact window 112. The impact of secondary electrons e2 on window 112 is the major cause of the extremely high temperatures experienced in window 112 and the adjacent structure. Thus, by limiting the number of secondary electrons e2 which are able to impact window 112 and the adjacent structure, the geometry of window block 600 serves to reduce the temperatures there. While the geometry of window block 600 contributes significantly to reduced temperatures in window 112 and the adjacent structure, window block 600 possesses other features as well which further enhance the cooling of window 112.

For example, window block 600 preferably comprises a window block flow passage 604. In one embodiment, window block flow passage 604 winds around window block cavity 602 for substantially the length of window block 600, and thus appears as a plurality of circular openings in window block 600 in the cross-section view of window block 600 illustrated in FIG. 5. It will be appreciated that a variety of other window block flow passage configurations would be equally well suited to provide the functionality of window block flow passage 604 as disclosed herein, and those alternate configurations are therefore contemplated as being within the scope of the present invention.

Window block flow passage 604 is in fluid communication with outlet port 504 of shield structure 500, so that liquid coolant 302 exiting flow passage 506 is first circulated throughout window block flow passage 604 before finally exiting window block outlet port 606 and into reservoir 300, as indicated in FIGS. 5 and 5A. Thus, at least a portion of the heat generated in window block 600 and the adjacent structure, as a result of the impact thereon by secondary electrons e2, is transferred to liquid coolant 302 as it passes through window block flow passage 604.

Window block 600 contributes to enhanced cooling of window 112 and the adjacent structure in at least one other way. In particular, exterior surface 608 of window block 600 is in substantial contact with liquid coolant 302 contained in reservoir 300, so that at least a portion of the heat generated in window block 600 by secondary electrons e2 is readily transferred from window block 600 to that liquid coolant 302 contained in reservoir 300. Transfer of heat in this way thus reduces the heat load placed on liquid coolant 302 circulating through window block flow passage 604, and thereby enables that liquid coolant 302 to absorb relatively more heat from window 112 and the adjacent structure than would otherwise be possible.

In summary then, window block 600 helps facilitate effective an efficient cooling of window 112 by cooling system 200 in at least three ways: first, the geometry of window block 600 is calculated to substantially decrease the likelihood that secondary electrons e2 will impact window 112, so that heat produced in window 112 and the adjacent structure will be significantly reduced; second, window block 600 provides a window block flow passage 604 through which liquid coolant 302 can flow so as to facilitate heat transfer from window block 600 to liquid coolant 302; and finally, because exterior surface 608 of window block 600 -is in substantial contact with liquid coolant 302 contained in reservoir 300, heat transfer from exterior surface 608 to liquid coolant 302 is thereby effectuated.

In summary, embodiments of the present invention provided enhanced cooling over systems in the prior art, especially with respect to specific regions of the tube. In particular, the aperture portion 104 and the window 112 are routinely subjected to extremely high temperatures that can shorten the life of x-ray tube 100 if not mitigated or counteracted in some way. Effective and efficient removal of heat from those areas, such as is effectuated by cooling system 200, thus serves to extend the operational life of x-ray tube 100 by removing heat that otherwise could melt x-ray tube structures such as vacuum enclosure 102, and/or induce destructive mechanical stresses in those structures.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An x-ray tube comprising:

(a) a vacuum enclosure with an electron source disposed therein and defining an aperture portion through which electrons emitted by said electron source pass;

(b) a target anode disposed in said vacuum enclosure, said target anode having a target surface positioned to receive electrons passing through said aperture portion;

(c) a deflection device disposed about said aperture portion of said vacuum enclosure, said deflection device directing said electrons along a desired path to said target anode;

(d) at least one fluid passageway formed within a shield structure attached to said vacuum enclosure substantially adjacent to the deflection device and the aperture portion, wherein the at least one passageway is capable of directing a flow of coolant proximate to at least said aperture portion so that at least some heat dissipated from the aperture portion is absorbed by the coolant; and (e) a window block attached to the vacuum enclosure, the window block extending an x-ray transmissive window a predetermined distance away from the target anode, and wherein the window block includes at least one window block flow passage capable of directing the flow of coolant so that at least some heat dissipated from the window block is absorbed by the coolant.

2. An x-ray tube comprising:

(a) a vacuum enclosure with an electron source disposed therein and defining an aperture portion through which electrons emitted by said electron source pass;

(b) a target anode disposed in said vacuum enclosure, said target anode having a target surface positioned to receive electrons passing through said aperture portion;

(c) a deflection device disposed about said aperture portion of said vacuum enclosure, said deflection device directing said electrons along a desired path to said target anode; and (d) at least one fluid passageway that is at least partially defined by a shield structure attached to said vacuum enclosure, wherein the at least one passageway is capable of directing a flow of coolant proximate to at least said aperture portion so that at least some heat dissipated from the aperture portion is absorbed by the coolant.

3. An x-ray tube as recited in claim 2, further comprising an auxiliary shield structure attached to the vacuum enclosure, wherein the auxiliary shield structure defines at least one outlet fluid passageway that directs at least a portion of the coolant over an x-ray window on the vacuum enclosure.

4. An x-ray tube as recited in claim 2, further comprising a window block attached to the vacuum enclosure, the window block extending an x-ray transmissive window a predetermined distance away from the target anode.

5. An x-ray tube as recited in claim 4, wherein said window block includes at least one window block flow passage capable of directing the flow of coolant so that at least some heat dissipated from the window block is absorbed by the coolant.

6. A cooling system for an x-ray tube, comprising:

(a) a reservoir containing coolant in which an evacuated housing of the x-ray tube is at least partially immersed, said coolant being continuously circulated through said reservoir by an external cooling unit; and (b) a shield structure attached to the evacuated housing, the shield structure having an inlet port and an outlet port, said shield structure being positioned substantially proximate to an aperture portion formed in the evacuated housing and at least partially enclosing a deflection device, wherein the shield structure receives coolant from the external cooling unit through the inlet port and directs the coolant along a path that is adjacent to the aperture portion so that at least some heat dissipated from the aperture is absorbed by the coolant and then discharged through the outlet port into the reservoir.

7. The cooling system as recited in claim 6, wherein all of the coolant is directed to the inlet port of the shield structure prior to entering the reservoir.

8. The cooling system as recited in claim 6, wherein the shield structure further comprises an auxiliary shield structure attached to the shield structure, the auxiliary shield structure directing at least a portion of said coolant discharged through said outlet port over an x-ray transmissive window of the x-ray tube.

9. The cooling system as recited in claim 6, further comprising a window block in which an x-ray transmissive window is disposed, the window block defining a window block flow passage through which at least a portion of said coolant discharged from said outlet port flows.

10. A method for cooling an x-ray tube comprising the steps of:

(a) providing a flow passage that is defined by a shield structure that is attached to an x-ray tube evacuated housing, the flow passage being substantially proximate to an aperture formed with the x-ray tube evacuated housing;

(b) passing a coolant through said flow passage so that the coolant absorbs at least a portion of the heat dissipated from the aperture;

(c) discharging the coolant from the flow passage;

(d) removing at least a portion of the heat from the coolant discharged from the flow passage;

(e) returning the coolant to the flow passage; and (f) repeating steps (b) through (e).

11. The method as recited in claim 10, further comprising the step of directing at least a portion of said discharged coolant proximate to a window of the x-ray tube so that said discharged coolant removes heat from said window and adjacent structure.

12. The method as recited in claim 10, further comprising the steps of defining a window block flow passage proximate to a window of the x-ray tube, and directing at least a portion of said discharged coolant through said window block flow passage so that said coolant removes heat from said window and adjacent structure.

13. The method as recited in claim 10, further comprising the step of placing said coolant discharged from said flow passage into contact with at least a portion of the x-ray tube so that said coolant absorbs heat therefrom.

14. The method as recited in claim 13, wherein said step of placing said coolant discharged from said flow passage into contact with at least a portion of the x-ray tube comprises collecting said discharged coolant and surrounding said portion of the x-ray tube with said discharged coolant collected.

15. In an x-ray tube comprising a vacuum enclosure defining an aperture portion and at least partially disposed within a reservoir containing coolant continuously circulated therethrough by an external cooling unit, and a deflection device being disposed about the aperture portion, and a window being proximate to the aperture portion, a shield structure attached to the exterior of the vacuum enclosure, the shield structure comprising:

(a) an inlet port, said inlet port being in communication with the external cooling unit, the coolant supplied by the external cooling unit being directed to said inlet port;

(b) a body defining a flow passage proximate to the aperture portion and the deflection device, said flow passage being in communication with said inlet port, and said flow passage allowing coolant to flow therethrough and absorb heat from at least the aperture portion of tile vacuum enclosure; and (c) an outlet port in communication with said flow passage, said coolant discharging from said outlet port after flowing through said flow passage.

16. The shield structure as recited in claim 15, wherein said inlet port is located proximate to the window of the x-ray tube.

17. The shield structure as recited in claim 15, further comprising an auxiliary shield structure, said auxiliary shield structure directing at least a portion of the coolant discharged to a predetermined location.

18. The shield structure as recited in claim 17, wherein said predetermined location comprises the window and adjacent structure.

19. The shield structure as recited in claim 17, wherein said auxiliary shield structure is integral with said shield structure.

20. The shield structure as recited in claim 15, wherein said shield structure comprises stainless steel.

21. The shield structure as recited in claim 15, wherein said shield structure substantially encloses the deflection device.

22. A cooling system for an x-ray tube, comprising:

(a) a reservoir containing coolant in which an evacuated housing of the x-ray tube is at least partially immersed, said coolant being continuously circulated through said reservoir by an external cooling unit;

(b) a shield structure having an inlet port and an outlet port, said shield structure being positioned substantially proximate to an aperture portion formed in the evacuated housing and at least partially enclosing a deflection device, wherein the shield structure receives coolant from the external cooling unit through the inlet port and directs the coolant along a path that is adjacent to the aperture portion so that at least some heat dissipated from the aperture is absorbed by the coolant and then discharged through the outlet port into the reservoir; and (c) a window block in which an x-ray transmissive window is disposed, the window block defining a window block flow passage through which at least a portion of said coolant discharged from said outlet port flows.

23. A method for cooling an x-ray tube comprising the steps of:

(a) providing a flow passage that is substantially proximate to an aperture formed with an x-ray tube evacuated housing;

(b) passing a coolant through said flow passage so that the coolant absorbs at least a portion of the heat dissipated from the aperture;

(c) discharging the coolant from the flow passage;

(d) defining a window block flow passage proximate to a window of the x-ray tube;

(e) directing at least a portion of said discharged coolant through said window block flow passage so that said coolant removes heat from said window and adjacent structure;

(f) removing at least a portion of the heat from the coolant discharged from the flow passage;

(g) returning the coolant to the flow passage; and (f) repeating steps (b) through (e).

* * * * *

UNITED STATES PATENT AND TRADEMARK OFFICE

CERTIFICATE OF CORRECTION

PATENT NO. : 6,529,579 B1
DATED : March 4, 2003
INVENTOR(S) : John Richardson

It is certified that error appears in the above-identified patent and that said Letters Patent is hereby corrected as shown below:

Column 1,
Line 33, after “electrons” insert -- to --

Column 6,
Line 27, delete “3”

Column 10,
Line 22, change “an” to -- and --
Line 32, change “-is” to -- is --

Column 12,
Line 64, change “tile” to -- the --

Signed and Sealed this

Second Day of September, 2003

JAMES E. ROGAN
*Director of the United States Patent and Trademark Office*